US008474263B2

(12) United States Patent
Kalina

(10) Patent No.: US 8,474,263 B2
(45) Date of Patent: Jul. 2, 2013

(54) HEAT CONVERSION SYSTEM SIMULTANEOUSLY UTILIZING TWO SEPARATE HEAT SOURCE STREAM AND METHOD FOR MAKING AND USING SAME

(75) Inventor: Alexander I. Kalina, Hillsborough, CA (US)

(73) Assignee: Kalex, LLC, Belmont, CA (US)

( * ) Notice: Subject to any disclaimer, the term of this patent is extended or adjusted under 35 U.S.C. 154(b) by 468 days.

(21) Appl. No.: 12/764,281

(22) Filed: Apr. 21, 2010

(65) Prior Publication Data

US 2011/0259011 A1 Oct. 27, 2011

(51) Int. Cl.
*F01K 7/34* (2006.01)

(52) U.S. Cl.
USPC ..... 60/653; 60/670

(58) Field of Classification Search
USPC ..... 60/649, 651, 653, 670
See application file for complete search history.

(56) References Cited

U.S. PATENT DOCUMENTS

| | | | | |
|---|---|---|---|---|
| 3,146,761 | A | 9/1964 | Blodgett | |
| 3,660,980 | A | 5/1972 | Knirsch et al. | |
| 3,696,587 | A | 10/1972 | Young et al. | |
| 3,712,073 | A | 1/1973 | Arenson | |
| 3,867,907 | A | 2/1975 | Marsch et al. | |
| 3,979,914 | A | 9/1976 | Weber | |
| 4,010,246 | A | 3/1977 | Steinrotter et al. | |
| 4,164,849 | A | 8/1979 | Mangus | |
| 4,183,225 | A | 1/1980 | Politte et al. | |
| 4,324,102 | A | 4/1982 | Woinsky | |
| 4,326,581 | A | 4/1982 | Rapier | |
| 4,346,561 | A | 8/1982 | Kalina | 60/673 |
| 4,433,545 | A | 2/1984 | Chang | |
| 4,442,679 | A | 4/1984 | Stafford et al. | |
| 4,489,563 | A | 12/1984 | Kalina | 60/673 |
| 4,548,043 | A | 10/1985 | Kalina | 60/673 |
| 4,586,340 | A | 5/1986 | Kalina | 60/673 |
| 4,604,867 | A | 8/1986 | Kalina | 60/653 |
| 4,619,809 | A | 10/1986 | Schluderberg | 376/402 |
| 4,674,285 | A | 6/1987 | Durrant et al. | |
| 4,704,877 | A | 11/1987 | Selcukoglu | |
| 4,732,005 | A | 3/1988 | Kalina | 60/673 |
| 4,739,713 | A | 4/1988 | Vier et al. | |
| 4,753,758 | A | 6/1988 | Miller | |
| 4,763,480 | A | 8/1988 | Kalina | 60/649 |

(Continued)

FOREIGN PATENT DOCUMENTS

| | | | |
|---|---|---|---|
| DE | 3933731 | A1 | 4/1990 |
| EP | 1331444 | A | 7/2003 |

(Continued)

OTHER PUBLICATIONS

U.S. Appl. No. 11/227,991, filed Sep. 15, 2005, Kalina.

(Continued)

*Primary Examiner* — Thomas Denion
*Assistant Examiner* — Jason Shanske
(74) *Attorney, Agent, or Firm* — Robert W. Strozier

(57) ABSTRACT

A system and method are disclosed for converting heat into a usable form of energy, where the system and method are designed to utilize at least two separate heat sources simultaneously, where one heat source stream has a higher initial temperature and a second heat source stream has a lower initial temperature, which is transferred to and a multi-component working fluid from which thermal energy is extracted.

20 Claims, 1 Drawing Sheet

U.S. PATENT DOCUMENTS

| | | | | |
|---|---|---|---|---|
| 4,817,392 | A | 4/1989 | Agrawal et al. | |
| 4,819,437 | A | 4/1989 | Dayan | |
| 4,832,718 | A | 5/1989 | Mehra | |
| 4,899,545 | A | 2/1990 | Kalina | 60/673 |
| 4,982,568 | A | 1/1991 | Kalina | 60/649 |
| 5,019,143 | A | 5/1991 | Mehrta | |
| 5,029,444 | A | 7/1991 | Kalina | 60/673 |
| 5,038,567 | A | 8/1991 | Mortiz | |
| 5,095,708 | A | 3/1992 | Kalina | 60/673 |
| 5,103,899 | A | 4/1992 | Kalina | 165/104.13 |
| 5,440,882 | A | 8/1995 | Kalina | 60/641.2 |
| 5,450,821 | A | 9/1995 | Kalina | 122/1 R |
| 5,572,871 | A | 11/1996 | Kalina | 60/649 |
| 5,588,298 | A | 12/1996 | Kalina et al. | 60/676 |
| 5,603,218 | A | 2/1997 | Hooper | |
| 5,649,426 | A | 7/1997 | Kalina et al. | 60/649 |
| 5,754,613 | A | 5/1998 | Hashiguchi et al. | |
| 5,784,888 | A | 7/1998 | Termeuhlen | |
| 5,797,981 | A | 8/1998 | Collin et al. | |
| 5,822,990 | A | 10/1998 | Kalina et al. | 60/649 |
| 5,893,410 | A | 4/1999 | Halbrook | |
| 5,950,433 | A | 9/1999 | Kalina et al. | 60/649 |
| 5,953,918 | A * | 9/1999 | Kalina et al. | 60/653 |
| 6,015,451 | A | 1/2000 | Anderson et al. | |
| 6,035,642 | A | 3/2000 | Peletz et al. | |
| 6,058,695 | A | 5/2000 | Ranasinghe et al. | |
| 6,065,280 | A | 5/2000 | Ranasinghe et al. | |
| 6,158,220 | A | 12/2000 | Hansen et al. | |
| 6,158,221 | A | 12/2000 | Fancher et al. | |
| 6,167,705 | B1 | 1/2001 | Hansen et al. | |
| 6,170,263 | B1 | 1/2001 | Chow et al. | |
| 6,195,998 | B1 | 3/2001 | Hansen et al. | |
| 6,202,418 | B1 | 3/2001 | Gabrielli et al. | |
| 6,223,535 | B1 | 5/2001 | Kitz | |
| 6,347,520 | B1 | 2/2002 | Ranasinghe et al. | |
| 6,393,840 | B1 | 5/2002 | Hay | |
| 6,435,484 | B1 | 8/2002 | Uehara | |
| 6,464,492 | B1 | 10/2002 | Guarco et al. | 432/91 |
| 6,735,948 | B1 * | 5/2004 | Kalina | 60/649 |
| 6,769,256 | B1 * | 8/2004 | Kalina | 60/653 |
| 6,820,421 | B2 | 11/2004 | Kalina | 60/649 |
| 6,829,895 | B2 | 12/2004 | Kalina | 60/649 |
| 6,910,334 | B2 | 6/2005 | Kalina | 60/651 |
| 6,923,000 | B2 | 8/2005 | Kalina | 60/649 |
| 6,941,757 | B2 | 9/2005 | Kalina | 60/649 |
| 6,968,690 | B2 | 11/2005 | Kalina | 60/649 |
| 7,021,060 | B1 | 4/2006 | Kalina | 60/649 |
| 7,043,919 | B1 | 5/2006 | Kalina | 60/651 |
| 7,055,326 | B1 | 6/2006 | Kalina | 60/649 |
| 7,065,967 | B2 | 6/2006 | Kalina | 60/649 |
| 7,065,969 | B2 | 6/2006 | Kalina | 60/670 |
| 7,104,784 | B1 | 9/2006 | Hasegawa et al. | 431/4 |
| 7,197,876 | B1 | 4/2007 | Kalina | 60/649 |
| 7,264,654 | B2 | 9/2007 | Kalina | 95/228 |
| 7,305,829 | B2 * | 12/2007 | Mirolli et al. | 60/649 |
| 7,350,471 | B2 | 4/2008 | Kalina | 110/348 |
| 7,398,651 | B2 | 7/2008 | Kalina | 60/649 |
| 7,458,217 | B2 | 12/2008 | Kalina | |
| 7,493,768 | B2 | 2/2009 | Klaus et al. | |
| 7,509,794 | B2 | 3/2009 | Bruckner et al. | |
| 7,841,179 | B2 | 11/2010 | Kalina | |
| 2003/0154718 | A1 | 8/2003 | Nayar | |
| 2003/0167769 | A1 | 9/2003 | Bharathan | |
| 2004/0050048 | A1 | 3/2004 | Kalina | |
| 2004/0055302 | A1 * | 3/2004 | Kalina | 60/649 |
| 2004/0069015 | A1 | 4/2004 | Paradowski | |
| 2004/0069244 | A1 | 4/2004 | Schroeder | |
| 2004/0148935 | A1 * | 8/2004 | Kalina | 60/649 |
| 2004/0182084 | A1 * | 9/2004 | Kalina | 60/698 |
| 2005/0050891 | A1 * | 3/2005 | Kalina | 60/649 |
| 2005/0061654 | A1 | 3/2005 | Kalina | 203/21 |
| 2005/0066660 | A1 * | 3/2005 | Mirolli et al. | 60/651 |
| 2005/0066661 | A1 | 3/2005 | Kalina | |
| 2005/0183418 | A1 * | 8/2005 | Kalina | 60/517 |
| 2005/0235645 | A1 | 10/2005 | Kalina | |
| 2006/0096288 | A1 | 5/2006 | Kalina | 60/649 |
| 2006/0096289 | A1 | 5/2006 | Kalina | |
| 2006/0096290 | A1 | 5/2006 | Kalina | 60/649 |
| 2006/0165394 | A1 | 7/2006 | Kalina | 392/386 |
| 2006/0199120 | A1 | 9/2006 | Kalina | 431/9 |
| 2007/0056284 | A1 * | 3/2007 | Kalina | 60/618 |
| 2007/0068161 | A1 | 3/2007 | Kalina | |
| 2007/0234722 | A1 | 10/2007 | Kalina | |
| 2007/0234750 | A1 | 10/2007 | Kalina | |
| 2008/0000225 | A1 | 1/2008 | Kalina | |
| 2008/0053095 | A1 * | 3/2008 | Kalina | 60/649 |
| 2009/0249779 | A1 * | 10/2009 | Shiao | 60/517 |
| 2010/0083662 | A1 | 4/2010 | Kalina | |
| 2010/0101227 | A1 * | 4/2010 | Kalina | 60/653 |
| 2010/0122533 | A1 | 5/2010 | Kalina | |
| 2010/0146973 | A1 * | 6/2010 | Kalina | 60/653 |
| 2010/0205962 | A1 * | 8/2010 | Kalina | 60/641.8 |
| 2011/0024084 | A1 | 2/2011 | Kalin | |
| 2011/0067400 | A1 * | 3/2011 | Kalina | 60/651 |
| 2011/0174296 | A1 | 7/2011 | Kalina | |

FOREIGN PATENT DOCUMENTS

| | | | |
|---|---|---|---|
| EP | 1936129 | A2 | 6/2008 |
| FR | 1111784 | A | 3/1956 |
| FR | 2885169 | A | 11/2006 |
| GB | 340780 | A | 1/1931 |
| GB | 504114 | A | 4/1939 |
| GB | 798786 | A | 7/1958 |
| GB | 2335953 | A | 10/1999 |
| JP | 61041850 | A | 2/1986 |
| KR | 100846128 | B1 | 7/2008 |
| WO | WO9407095 | | 3/1994 |
| WO | WO03048529 | | 6/2003 |
| WO | WO2004109075 | | 12/2004 |

OTHER PUBLICATIONS

U.S. Appl. No. 11/235,654, filed Sep. 22, 2005, Kalina.
U.S. Appl. No. 11/238,173, filed Sep. 28, 2005, Kalina.
U.S. Appl. No. 11/399,287, filed Apr. 5, 2006, Kalina.
U.S. Appl. No. 11/399,306, filed Apr. 5, 2006, Kalina.
U.S. Appl. No. 11/514,290, filed Aug. 31, 2006, Kalina.

* cited by examiner

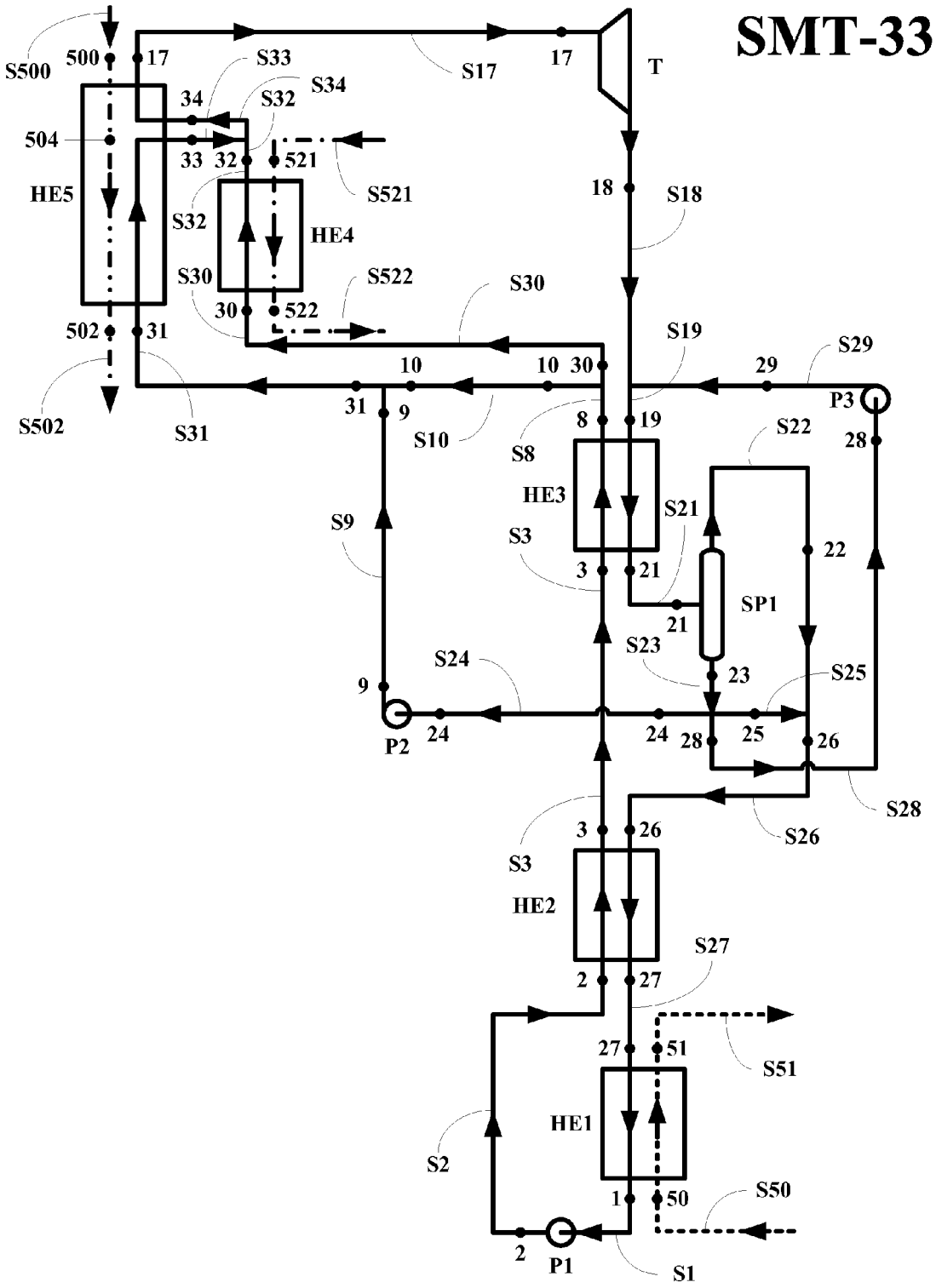
SMT-33
S500
500
17
S33
S34
S17
17
T
34
S32
504
33
32
521
S521
HE5
18
S18
S32
HE4
S30
S522
S30
30
522
502
31
S19
S29
10
10
30
29
P3
S502
S31
31
9
S10
8
19
S22
28
S8
HE3
S21
S9
S3
22
3
21
SP1
21
S23
S24
23
S25
9
P2
24
24
28
25
26
S28
3
26
S26
S3
HE2
S27
2
27
27
51
S51
HE1
S2
1
50
S50
2
P1
S1

HEAT CONVERSION SYSTEM SIMULTANEOUSLY UTILIZING TWO SEPARATE HEAT SOURCE STREAM AND METHOD FOR MAKING AND USING SAME

BACKGROUND OF THE INVENTION

1. Field of the Invention

Embodiments of the present invention relates to systems for converting heat into a usable form of energy designed to utilize at least two separate heat sources simultaneously.

Embodiments of the present invention relates to systems for converting heat into a usable form of energy designed to utilize at least two separate heat sources simultaneously, where one heat source stream has a higher initial temperature and a second heat source stream has a lower initial temperature, which is transferred to and a multi-component working fluid from which thermal energy is extracted.

2. Description of the Related Art

Although many power generation systems and methodologies have been developed for the conversion of a portion of the energy in heat of heat source stream into usable forms of energy, there is still a need in the art for new systems, especially systems that are capable of utilizing at least two separate heat source stream simultaneously.

SUMMARY OF THE INVENTION

Embodiments of this invention provide systems for converting heat to a usable form of energy utilizing at least two heat source streams simultaneously. The systems include an energy conversion subsystem, where a portion of heat or thermal energy associated with a superheated working solution stream is converted to a usable form of energy. The system also includes a vaporization and superheating subsystem. The vaporization and superheating subsystem includes a higher temperature component. The higher temperature component is adapted (a) to fully vaporize and superheat, in a lower section of a higher temperature heat exchange unit, a combined stream comprising a rich basic solution substream and a lean solution substream, each having the same or substantially the same pressure, to form a fully vaporized and superheated combined stream using heat from a higher temperature heat source stream and (b) to further superheat, in an upper section of the higher temperature heat exchange unit, a working solution stream comprising the fully vaporized and superheated combined stream and a fully vaporized and superheated, rich basic solution stream to form the superheated working solution stream using heat from the higher temperature heat source stream. The vaporization and superheating subsystem also includes a lower temperature component adapted to fully vaporize and superheat, in a lower temperature heat exchange unit, a partially vaporized, rich basic solution substream using heat from a lower temperature heat source stream to form the fully vaporized and superheated, rich basic solution stream. The system also includes a heat exchange, separation and condensation subsystem including at least three heat exchange units, a gravity separator and three pumps. The heat exchange, separation and condensation subsystem forms a condensing solution stream, a rich vapor stream, a liquid lean solution stream and a lower pressure rich basic solution stream from a spent working solution stream, heats and cools different streams, separates the condensing solution stream into the rich vapor stream and the liquid lean solution stream and a fully condensed rich basic solution stream condensed using an external coolant stream, where the external coolant is air (or a gas) or water.

Embodiments of this invention provide methods for converting heat into a usable form of energy simultaneously utilizing a higher temperature heat source stream and a lower temperature heat source stream. The methods include converting a portion of heat or thermal energy in a superheated working solution stream into a usable form of energy in a heat conversion subsystem to form a spent working solution stream. The method includes forming a lower pressure, rich basic solution stream from a rich vapor stream and a first liquid lean solution substream derived from a partially condensed condensing solution stream after being separated in a gravity separator of a heat exchange unit of a heat exchange, separation and condensation subsystem. The lower pressure, rich basic solution stream is passed through a first heat exchange unit of the heat exchange, separation and condensation subsystem in counterflow with a higher pressure, fully condensed rich basic solution stream to form a cooled lower pressure, rich basic solution stream and a pre-heated higher pressure, fully condensed, rich basic solution. The cooled lower pressure, rich basic solution stream is then fully condensed in a second heat exchange unit of the heat exchange, separation and condensation subsystem in counterflow with an external coolant stream to form a fully condensed, lower pressure, rich basic solution stream. The fully condensed, lower pressure, rich basic solution stream is then pressurized in a first pump of the heat exchange, separation and condensation subsystem to form the higher pressure, fully condensed, rich basic solution stream. The condensing solution stream is separated in the gravity separator into the rich vapor stream and a liquid lean solution stream, which is then divided into three lean solution substreams, one of which was used to from the lower pressure, rich basic solution stream. A second lean solution substream is passed through a second pump of the heat exchange, separation and condensation subsystem, where its pressure is increased to a pressure equal to or substantially equal to a pressure of the spent working solution stream. The higher pressure, second lean solution substream is then combined with the spent working solution stream, where the second lean solution substream de-superheats the spent working solution stream to form a condensing solution stream. The condensing solution stream is then passed through a third heat exchange unit of the heat exchange, separation and condensation subsystem in counter flow with the preheated, higher pressure, rich basic solution stream to form a partially vaporized, higher pressure, rich basic solution stream and a partially condensed condensing solution stream, which then enters the gravity separator. The partially vaporized, higher pressure, rich basic solution stream is then divided into a first and second substream. The first partially vaporized, higher pressure, rich basic solution substream is forwarded to a lower temperature vaporization and superheating component of a vaporization and superheating subsystem, while the second partially vaporized, higher pressure, rich basic solution substream is combined with a second lean solution stream, having passed through a third pump of the heat exchange, separation and condensation subsystem, where its pressure is increased to a pressure that is the same or substantially the same as a pressure of the second, partially vaporized, higher pressure rich basic solution substream. The combined stream is then forwarded to a higher temperature vaporization and superheating component, completing the cycle, where it is fully vaporized and superheated in a lower section of the higher temperature heat exchange unit. The stream is then combined with the fully vaporized and superheated, rich basic solution substream to form the working solution stream, which is then further superheated in an upper section of the higher temperature heat exchange unit.

BRIEF DESCRIPTION OF THE DRAWINGS

The invention can be better understood with reference to the following detailed description together with the appended illustrative drawings in which like elements are numbered the same:

FIG. 1 depicts an embodiment of the present invention including a higher temperature vaporization and superheating component using a higher temperature heat source stream and a lower temperature vaporization and superheating component using a lower temperature heat source stream.

DETAILED DESCRIPTION OF THE INVENTION

The inventor has found that a new power generation system can be constructed using a multi-components working fluid and two separate heat sources simultaneously. The system is designed to use a higher initial temperature heat source stream and a lower initial temperature heat source stream. In certain embodiments, the higher temperature heat source stream is a flue-gas stream, while the lower initial temperature heat source stream is a hot air stream. In other embodiments, the higher temperature heat source stream is a flue-gas stream, while the lower initial temperature heat source stream is a hot water stream. In other embodiments, the higher temperature heat source stream is a flue-gas stream, while the lower initial temperature heat source stream is a geothermal heat source stream.

The present invention broadly relates to a system for converting heat from at least two heat source streams, one having a higher temperature and one having a lower temperature. The system includes an energy conversion subsystem, where a portion of heat or thermal energy associated with a superheated working solution stream is converted to a usable form of energy. In certain embodiments, the energy conversion subsystem comprises at least one turbine. The system also includes a vaporization and superheating subsystem, where the vaporization and superheating subsystem comprises a higher temperature component and a lower temperature component. The higher temperature component is used to fully vaporize and superheat at least two stream. One stream comprises a combined stream of a rich basic solution substream and a lean solution substream, each having the same or substantially the same pressure. The term substantially same pressure means that the pressures of the two streams are within about 10% of each other. In other embodiments, the pressures of the two streams are within about 5% of each other. In other embodiments, the pressures of the two streams are within about 1% of each other. This definition for substantially equal pressure attached to all subsequent uses for the term. This combined stream is vaporized and superheated in a lower section of a higher temperature heat exchange unit. The second stream comprises the fully vaporized and superheated combined stream and a fully vaporized and superheated rich basic solution stream to form a working solution stream, which is sent into an upper section of the higher temperature heat exchange unit, where it is further superheated to form the superheated working solution stream. In certain embodiments, the higher temperature components utilizes a higher temperature flue gas stream, but other higher temperature streams can be used as well. The lower temperature component is used to fully vaporize and superheat a partially vaporized rich basic solution stream using a lower temperature heat source in a lower temperature heat exchange unit to form the fully vaporized and superheated rich basic solution stream. The system also includes a heat exchange, separation and condensation subsystem including at least three heat exchange units, and a gravity separator three pumps. The heat exchange, separation and condensation subsystem forms the other stream from a fully condensed rich basic solution stream condensed using an external coolant stream and from a spent working solution stream.

The present invention broadly relates to a method for simultaneously utilizing heat derived from a higher temperature heat source stream and a lower temperature heat source stream to form a superheated working solution stream from which a portion of its heat or thermal energy is converted to a usable form of energy to form a spent working solution stream. The method includes forming a lower pressure, rich basic solution stream from a rich vapor stream and a first lean liquid substream derived from a partially condensed condensing solution stream after being separated in a gravity separator of a heat exchange unit of the heat exchange, separation and condensation subsystem. The lower pressure, rich basic solution stream is passed through a first heat exchange unit of the heat exchange, separation and condensation subsystem in counterflow with a higher pressure, fully condensed rich basic solution stream to form a cooled lower pressure, rich basic solution stream and a pre-heated higher pressure, fully condensed rich basic solution. The cooled lower pressure, rich basic solution stream is then fully condensed in a second heat exchange unit of the heat exchange, separation and condensation subsystem in counterflow with an external coolant stream to form a fully condensed, lower pressure, rich basic solution stream. The fully condensed, lower pressure, rich basic solution stream is then pressurized in a first pump of the heat exchange, separation and condensation subsystem to form the higher pressure, fully condensed rich basic solution stream. The condensing solution stream is separated in the gravity separator into the rich vapor stream and a liquid lean solution stream, which is then divided into three lean solution substreams, where the first substream was used to form the lower pressure, rich basic solution stream. A second lean solution substream is passed through a second pump of the heat exchange, separation and condensation subsystem, where its pressure is increased to a pressure equal to or substantially equal to a pressure of the spent working solution stream. The higher pressure, second lean solution substream is then combined with the spent working solution stream, where the lean solution substream de-superheats the spent working solution stream to form a condensing solution stream. The condensing solution stream is then passed through a third heat exchange unit of the heat exchange, separation and condensation subsystem in counterflow with the preheated, higher pressure, rich basic solution stream to form a partially vaporized, higher pressure, rich basic solution stream and a partially condensed condensing solution stream, which then enters the gravity separator. The partially vaporized, higher pressure, rich basic solution stream is then divided into a first and second substream. The first substream is forwarded to the lower temperature vaporization and superheating component, while the second substream is combined with a second lean solution stream, having passed through a third pump of the heat exchange, separation and condensation subsystem, where its pressure is increased to a pressure that is the same or substantially the same as a pressure of the second, partially vaporized, higher pressure rich basic solution substream. The combined stream is then forwarded to the higher temperature vaporization and superheating component. The combined stream is fully vaporized and superheated in a lower section of the higher temperature heat exchange. The fully vaporized and superheated combined stream is then combined with the fully vaporized and superheated, higher pressure, rich basic solution stream to from the working solution stream. The working solution stream is then further superheated in an upper section of the higher temperature heat exchange unit to from the superheated working solution stream, completing the cycle.

In all of the embodiments, mixing or combining valves are used to combine stream as each point where two or more streams are combined and dividing valves are used to divide a stream at each point where a stream is divided into two or more substreams. Such valves are well known in the art.

These systems of the invention are designed to operate with a multi-component working fluid including at least one lower boiling component and at least one higher boiling component. In certain embodiments, the working fluids include an ammonia-water mixture, a mixture of two or more hydrocarbons, a mixture of two or more freon, a mixture of hydrocarbons and freon, or the like. In general, the fluid can comprise mixtures of any number of compounds with favorable thermodynamic characteristics and solubility. In certain embodiments, the fluid comprises a mixture of water and ammonia.

DETAILED DESCRIPTION OF DRAWINGS

Referring to FIG. 1A, a first embodiment of the present system and method designated SMT-33 is described. A fully condensed, basic working solution stream S1 having parameters as at a point 1. The stream S1 comprises a rich basic solution stream having a higher concentration of a lower boiling component of a multi-component working fluid comprising at least one lower boiling point component and at least one higher boiling point component. In certain embodiments, the multi-component working solution comprise a mixture of water and ammonia. A rich solution represents a composition having a higher concentration of ammonia compared to a starting water-ammonia mixture. The stream S1 corresponds to a state of saturated liquid. The stream S1 then enters into a feed pump or first pump P1, where its pressure is increased to form a higher pressure, fully condensed rich solution stream S2 having parameters as at a point 2. The stream S2 corresponds to a state of a subcooled liquid.

The stream S2 having the parameters as at the point 2 now passes through a preheater or second heat exchange unit HE2. In the second heat exchange unit HE2, the stream S2 is heated in counterflow by a returning, condensing rich basic solution stream S26 having parameters as at a point 26 in a second heat exchange process 2-3 or 26-27 as described more fully below to form a preheated, higher pressure, rich basic solution stream S3 having parameters as at a point 3. The stream S3 corresponds to a state of saturated liquid.

Thereafter, the stream S3 passes through a recuperative boiler-condenser or third heat exchange unit HE3. In the third heat exchange unit HE3, the stream S3 is heated and substantially vaporized in counterflow by a condensing solution stream S19 having parameters as at a point 19 in a third heat exchange process 3-8 or 19-21 as described below to form a heated and substantially vaporized rich basic solution stream S8 having parameters as at a point 8 and a partially condensed, condensing solution stream S21 having parameters as at a point 21. The heated and substantially vaporized rich basic solution stream S8 having the parameters as at the point 8 corresponds to a state of wet vapor, i.e., a first liquid-vapor mixture. The term substantially vaporized means that at least 50% of the stream is vapor. In other embodiments, the term substantially vaporized means that at least 75% of the stream is vapor. In other embodiments, the term substantially vaporized means at least 80% of the stream is vapor.

The stream S21, which was partially condenses in the third heat exchange unit HE3, corresponds to a state of a second liquid-vapor mixture. The stream S21 then enters into a gravity separator SP1, where it is separated into a saturated rich vapor stream S22 having parameters as at a point 22 and a saturated liquid lean solution stream S23 having parameters as at a point 23.

A concentration of the lower boiling point component (usually ammonia) of the multi-component fluid making up the stream S22 is slightly higher than a concentration of the lower boiling point component making up the basic solution streams.

The lean solution stream S23 is now divided into three substreams S24, S25 and S28 having parameters as at points 24, 25 and 28.

The lean solution substream S25 is now combined with the rich vapor stream S22 to form the rich basic solution stream S26 having the parameters as at the point 26 as described above.

The lean solution substream S24 is now sent into a circulating pump or second pump P2, where its pressure is increased to a higher pressure equal to the pressure of the stream S8 having the parameters as at the point 8 as described above to form a higher pressure, lean solution substream S9 having parameters as at a point 9. The higher pressure, lean solution substream S9 corresponds to a state of subcooled liquid.

Meanwhile, the stream S8 is divided into two heated and substantially vaporized rich basic solution substreams S10 and S30 having parameters as at points 10 and 30, respectively. The term substantially vaporized means that at least 50% of the stream is vapor. In other embodiments, the term substantially vaporized means that at least 75% of the stream is vapor. In other embodiments, the term substantially vaporized means at least 80% of the stream is vapor.

The substream S10 is now combined with the higher pressure, lean solution substream S9 to form an intermediate solution stream S31 having parameters as at a point 31, where the stream S31 comprise a vapor-liquid mixture. Due to the absorption of the stream S10 by the stream S9, a temperature of the stream S31 having the parameters as at the point 31 is increased and becomes higher than a temperature of the stream S10 having the parameters as at the point 10.

Meanwhile, the substream S30 is sent into an evaporator or fourth heat exchange unit HE4. In the fourth heat exchange unit HE4, the substream S30 is heated, fully vaporized and superheated in counterflow by a lower temperature heat source stream S521 having parameters as at a point 521 in a fourth heat exchange process 30-32 or 521-522 to form a fully vaporized and superheated rich basic solution stream S32 having parameters as at a point 32. In certain embodiments, the fourth heat exchange unit HE4 can be a heat recovery and vapor generator (HRVG) unit.

At the same time, the intermediate solution stream S31 is new sent into a lower section of a fifth heat exchange unit HE5. In lower section of the fifth heat exchange unit HE5, the stream S31 is heated, fully vaporized and superheated by a flue-gas stream S500 having parameters as at a point 500 in a fifth heat exchange process 500-504 to form a fully vaporized and superheated intermediate solution stream S33 having parameters as at a point 33. In certain embodiments, the fifth heat exchange unit HE5 can be a heat recovery and vapor generator (HRVG) unit. The fifth heat exchange unit HE5 is, therefore, divided into the lower section, extending from a bottom of the fifth heat exchange unit HE5 to about the point 504 and an upper section extending from about the point 504 to a top of the fifth heat exchange unit HE5.

The stream S33 now exits from the fifth heat exchange unit HE5 at the point 504, where the intermediate solution stream S33 is combined with the fully vaporized and superheated, higher pressure, rich basic solution stream S32 to form a fully vaporized and superheated working solution stream S34 having parameters as at a point 34. The working solution stream S34 corresponds to a state of superheated vapor.

The stream S34 is now sent into the upper section of the fifth heat exchange unit HE5. In the upper section of the fifth heat exchange unit HE5, the stream S34 is further superheated in a sixth heat exchange process 34-17 or 500-504 to form a further superheated working solution stream S17 having parameters as at a point 17.

The stream S17 is now sent into a turbine T. In the turbine T, the stream S17 is expanded converting a portion of its heat or thermal energy into a usable form of energy to form a spent working solution stream S18 having parameters as at the point 18. The stream S18 corresponds to a state of superheated vapor.

Meanwhile, the lean solution substream S28 is sent into a circulating pump or third pump P3, where its pressure is increased to a pressure equal to a pressure at of the spend working solution stream S18 to form a higher pressure lean solution substream S29 having parameters as at a point 29. The substream S29 corresponds to a state of slightly subcooled liquid. The substream S29 is now mixed with the stream S18 to form a condensing solution stream S19 having parameters as at a point 19. The flow rate of the stream S29 is chosen in such a way that it de-superheats the stream S18, and that the stream S19 (resulting from the mixture of the streams S29 and S18) corresponds to a state of saturated or slightly wet vapor. The stream S19 is now sent into the third heat exchange unit HE3, where it condenses, providing heat for the third heat exchange process 3-8 or 19-21 to form the partially condensed, condensing solution stream S21 having the parameters as at the point 21 (see above.)

Meanwhile, the rich basic solution stream S26 having the parameters as at the point 26 and corresponding to a state of a liquid-vapor mixture, is sent into the second heat exchange unit HE2, where it partially condenses, providing heat for the second heat exchange process 2-3 or 26-27 to form the stream S27 having the parameters as at the point 27, corresponding to a state of liquid-vapor mixture (see above.)

Thereafter, the rich basic solution stream S27 is sent into a condenser or first heat exchange unit HE1. In the first heat exchange unit HE1, the partially condensed rich basic solution stream S27 is further cooled and fully condensed by a coolant stream S50 having parameters as at a point 50 in a first heat exchange process 1-2 or 50-51 to form a spent coolant stream S51 having parameters as at a point 51 and the fully condensed, basic solution stream S1 having the parameters as at a point 1 (see above). The coolant stream S50 can be air or water depending on design criteria. If increased cooling is needed, then the coolant stream can be sent through an exhaust fan or the water can pass through a pump.

The cycle is closed.

The system is operated so that a temperature of the stream S31 (see above) is always lower than a lowest allowable temperature of the spent flue gas stream S502 having the parameters as at the point 502.

The system is also operated so that the stream S30 has a temperature lower than a temperature of the stream S31 having the parameters as at the point 31. However, the temperature of the stream S30 having the parameter as at the point 30 is usually higher than the lowest allowable temperature of the lower temperature heat source stream S521 having the parameters as at the point 521, where the stream S521 can be a hot air stream, a hot water stream or a hot steam stream.

As a result, a heat potential of the higher temperature heat source stream is fully utilized, whereas a heat potential of the lower temperature heat source stream is utilized to a very significant extent, though not fully. Generally, the very significant extent means that at least 50% of its heat potential is used. In other embodiments, the very significant extent means that at least 75% of its heat potential is used. In other embodiments, the very significant extent means that at least 80% of its heat potential is used.

Thus, overall, the system SMT-33 attains a very high efficiency and a very high rate of heat utilization.

The thermodynamic cycle includes six compositional streams. Each stream has the same or a different mixture of the lower boiling point component and the higher boiling point component of the multi-component fluid used to form them in the cycle. Table 1 lists the compositions and the streams having the compositions.

TABLE 1

Compositions and Streams

| Composition | Streams |
|---|---|
| rich basic solution | S26, S27, S1, S2, S3, S8, S10, S30 and S32 |
| rich vapor | S22 |
| lean solution | S23, S24, S25, S28, S9, and S29 |
| intermediate solution | S31 and S33 |
| working solution | S34, S17 and S18 |
| condensing solution | S19 and S21 |

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

I claim:

1. A system for simultaneously converting a portion of heat from at least two heat source streams to a usable form of energy comprising:

an energy conversion subsystem, where a portion of heat or thermal energy associated with a superheated working solution stream is converted to a usable form of energy forming a spent working solution stream;

a vaporization and superheating subsystem including:

a higher temperature component having:

a lower section, where a combined stream is fully vaporized and superheated using heat from a higher temperature heat source stream to form a fully vaporized and superheated combined stream and where the combined stream comprises a first partially vaporized higher pressure rich basic solution substream and a higher pressure first lean solution substream, where the first partially vaporized higher pressure rich basic solution substream and the higher pressure first lean solution substream have the same or substantially the same pressure, and an upper section, where a working solution stream is fully vaporized and superheated using heat from the higher temperature heat source stream to form the superheated working solution stream, where the working solution stream comprises the fully vaporized and superheated combined stream and a second fully vaporized higher pressure rich basic solution substream, a lower temperature component, where a second partially vaporized higher pressure rich basic solution substream is fully vaporized and superheated using heat from a lower temperature heat source stream to form the fully vaporized and superheated second higher pressure rich basic solution substream;

a heat exchange, separation and condensation subsystem including at least three heat exchange units, a gravity separator and three pumps, where the heat exchange, separation and condensation subsystem forms a condensing solution stream, a rich vapor stream, a liquid lean solution stream and a lower pressure rich basic solution stream from a spent working solution stream, heats and cools different streams, separates the condensing solution stream into the rich vapor stream and the liquid lean solution stream, fully condenses the lower pressure rich basic solution stream using an external coolant stream, divides the lean solution stream into three substreams, pressurizes the fully condensed lower pressure rich basic solution stream and dividing the higher pressure rich basic solution stream into two substreams after heating to partially vaporize the streams in the at least two of the heat exchangers.

2. The system of claim 1, wherein the energy conversion subsystem comprises at least one turbine.

3. The system of claim 1, wherein the higher temperature heat source stream is a flue gas stream.

4. The system of claim 1, wherein the lower temperature heat source stream is a hot air stream.

5. The system of claim 1, wherein the external coolant is air or water.

6. The system of claim 1, wherein the streams are derived from a multi-component fluid.

7. The system of claim 6, wherein the multi-component fluid comprises at least one lower boiling component and at least one higher boiling component.

8. The system of claim 6, wherein the multi-component fluid comprises an ammonia-water mixture, a mixture of two or more hydrocarbons, a mixture of two or more freon, or a mixture of hydrocarbons and freon.

9. The system of claim 6, wherein the multi-component fluid comprises a mixture of any number of compounds including higher boiling point components and lower boiling point components.

10. The system of claim 6, wherein the multi-component fluid comprises a mixture of water and ammonia.

11. A method comprising:

forming a lower pressure, rich basic solution stream from a rich vapor stream and a first liquid lean solution substream, separating a partially condensed condensing solution stream in a gravity separator of a heat exchange, separation and condensation subsystem to form the rich vapor stream and a liquid lean solution stream, passing the lower pressure, rich basic solution stream through a second heat exchange unit of the heat exchange, separation and condensation subsystem in counterflow with a higher pressure, fully condensed rich basic solution stream to form a cooled lower pressure, rich basic solution stream and a pre-heated higher pressure, fully condensed rich basic solution, fully condensing the cooled lower pressure, rich basic solution stream in a first heat exchange unit of the heat exchange, separation and condensation subsystem in counterflow with an external coolant stream to form a fully condensed, lower pressure, rich basic solution stream, pressurizing the fully condensed, lower pressure, rich basic solution stream in a first pump of the heat exchange, separation and condensation subsystem to form the higher pressure, fully condensed rich basic solution stream, dividing the liquid lean solution stream into the first lean solution substream, a second lean solution substream and a third lean solution substream, pressurizing the second lean solution substream in a second pump of the heat exchange, separation and condensation subsystem, where its pressure is increased to a pressure equal to or substantially equal to a pressure of a spent working solution stream to form a higher pressure, second lean solution substream, combining the higher pressure, second lean solution substream with the spent working solution stream, where the higher pressure, second lean solution substream desuperheats the spent working solution stream to form a condensing solution stream, passing the condensing solution stream through a third heat exchange unit of the heat exchange, separation and condensation subsystem in counter flow with the preheated, higher pressure, rich basic solution stream to form a partially vaporized, higher pressure, rich basic solution stream and a partially condensed, condensing solution stream, dividing the partially vaporized, higher pressure, rich basic solution stream into a first partially vaporized, higher pressure, rich basic solution substream and a second partially vaporized, higher pressure, rich basic solution substream, forwarding first partially vaporized, higher pressure, rich basic solution substream to a lower temperature vaporization and superheating component of a vaporization and superheating subsystem, where it is fully vaporized and superheated in a lower temperature component exchange unit in counterflow with a lower temperature heat source stream to form a fully vaporized and superheated, higher pressure, rich basic solution substream, pressurizing the third lean solution substream in a third pump of the heat exchange, separation and condensation subsystem, where its pressure is increased to a pressure that is same or substantially the same as a pressure of the second, partially vaporized, higher pressure rich basic solution substream to form a higher pressure, third lean solution substream, combining the second, partially vaporized, higher pressure rich basic solution substream with the higher pressure, third lean solution substream to form a combined stream, forwarding the combined stream to a higher temperature vaporization and superheating component of the vaporization and superheating subsystem, where the combined stream is fully vaporized and superheated in a lower section of a higher temperature component heat exchange unit in counterflow with a higher temperature heat source stream to form a fully vaporized and superheated combined stream, combining the fully vaporized and superheated, higher pressure, rich basic solution substream with the fully vaporized and superheated combined stream to form a fully vaporized and superheated working solution stream, forwarding the fully vaporized and superheated working solution stream into an upper section of the higher temperature component heat exchange unit, where the fully vaporized and superheated working solution stream is further superheated to form a further superheated working solution stream, and forwarding the further superheated working solution stream to an energy conversion subsystem, where a portion of heat or thermal energy of the further superheated working solution stream is converted to a usable form of energy to form the spent working solution stream, completing a thermodynamic cycle.

12. The method of claim 11, wherein the energy conversion subsystem comprises at least one turbine.

13. The method of claim 11, wherein the higher temperature heat source stream is a flue gas stream.

14. The method of claim 11, wherein the lower temperature heat source stream is a hot air stream.

15. The method of claim 11, wherein the external coolant is air or water.

16. The method of claim 11, wherein the streams are derived from a multi-component fluid.

17. The method of claim 16, wherein the multi-component fluid comprises at least one lower boiling component and at least one higher boiling component.

18. The method of claim 16, wherein the multi-component fluid comprises an ammonia-water mixture, a mixture of two or more hydrocarbons, a mixture of two or more freon, or a mixture of hydrocarbons and freon.

19. The method of claim 16, wherein the multi-component fluid comprises a mixture of any number of compounds higher boiling point components and lower boiling point components.

20. The method of claim 16, wherein the multi-component fluid comprises a mixture of water and ammonia.

* * * * *